United States Patent [19]

Livezey

[11] 4,220,131

[45] Sep. 2, 1980

[54] FIREPLACE AIR HEATER

[75] Inventor: David J. Livezey, Kent, Wash.

[73] Assignee: Therm-Air Industries, Inc., Seattle, Wash.

[21] Appl. No.: 853,428

[22] Filed: Nov. 21, 1977

[51] Int. Cl.[2] ..... F24B 7/00

[52] U.S. Cl. ..... 126/121; 126/131; 126/164

[58] Field of Search ..... 126/121, 129, 130, 131, 126/164

[56] References Cited

U.S. PATENT DOCUMENTS

| | | | |
|---|---|---|---|
| 3,995,611 | 12/1976 | Nelson | 126/121 |
| 4,018,208 | 4/1977 | Hamilton | 126/121 |
| 4,062,345 | 12/1977 | Whiteley | 126/121 |

FOREIGN PATENT DOCUMENTS

| | | | |
|---|---|---|---|
| 487954 | 5/1918 | France | 126/130 |

*Primary Examiner*—Carroll B. Dority, Jr.
*Assistant Examiner*—Lee E. Barrett
*Attorney, Agent, or Firm*—Delbert J. Barnard

[57] ABSTRACT

A blower is attached to the forward end of a tubular base of dihedral form, which extends first along a lower side portion of a fireplace firebox and then along the lower rear portion of the firebox and terminates in a closed end. A short transfer duct extends upwardly from an intermdiate part of the rear portion of the base to an intermediate part of an elevated air-heating box. The air-heating box is elongated in the horizontal direction and leans forwardly. An outlet tube extends forwardly and upwardly from each of its ends to a discharge position at an upper forward corner portion of the fireplace firebox. The side portion of the tubular base includes a flange at its rear end, by which it is bolted to a similar flange at the end of the rear portion of the tubular base. A similar flange is provided at the opposite end of the rear portion of the tubular base and the side portion of the tubular base is invertible so that it can be attached to the opposite end of the rear portion of the tubular base. Lower portions of the flanges serve as support legs for the tubular base. A third point of support is provided at the forward end of the side portion of the tubular base.

5 Claims, 4 Drawing Figures

Fig. 1.
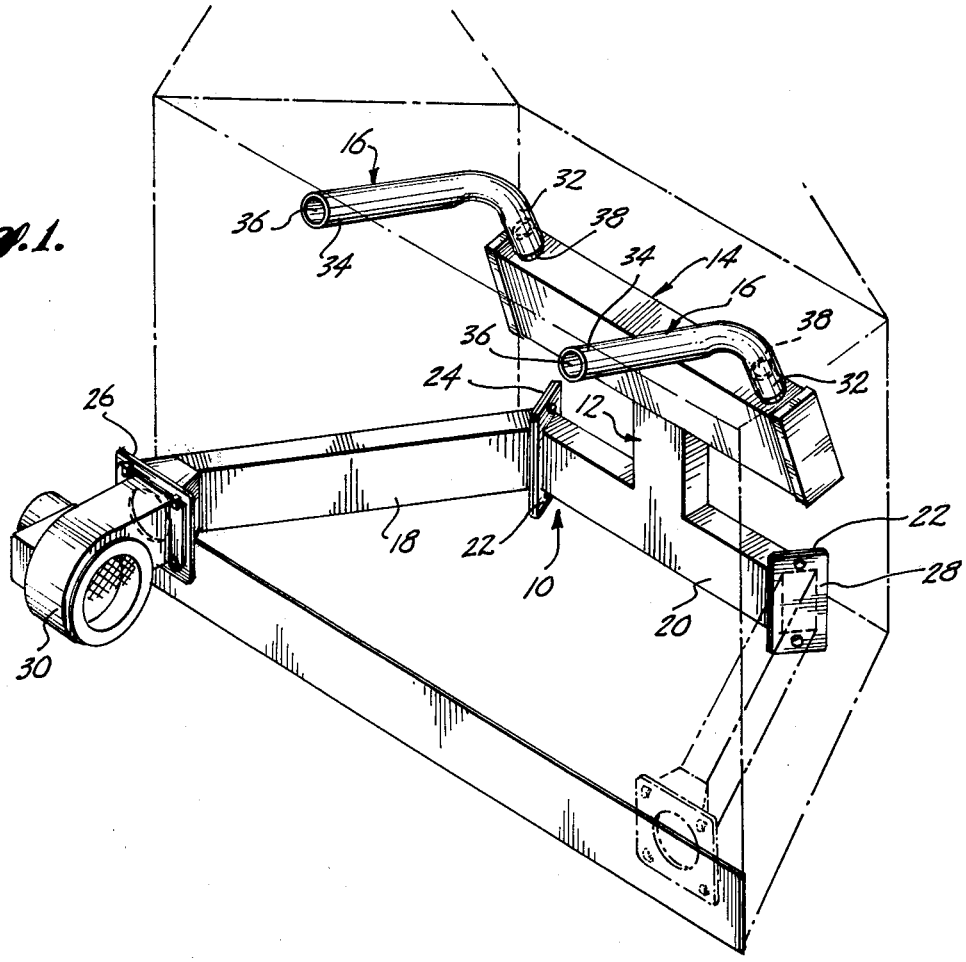
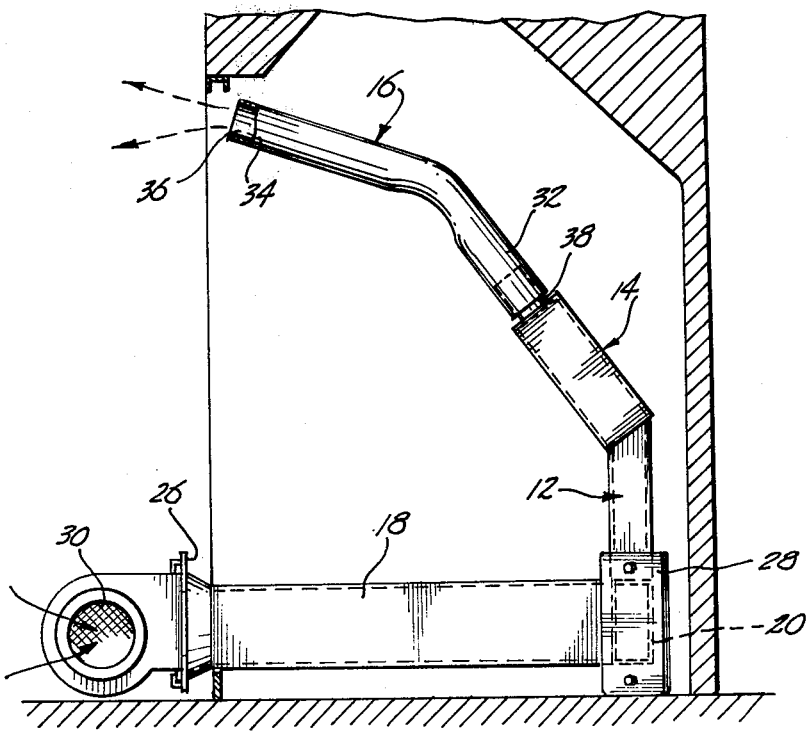
Fig. 2.

FIREPLACE AIR HEATER

BACKGROUND OF THE INVENTION

1. Field of the Invention

This invention relates to forced-air heaters adapted to be placed into fireplace fireboxes.

2. Description of the Prior Art

U.S. Pat. No. 4,008,706, granted Feb. 22, 1977, to John M. Buanno, discloses one form of fireplace air heater and describes several other forms. U.S. Pat. No. 4,008,706 and the several patents cited therein should be considered in attempting to put the present invention into proper perspective relative to the prior art.

It is known to heat air in a fireplace by means of a relatively large-size air-heater box that is placed in the rear portion of the fireplace firebox. Such air-heater box is quite wide and quite tall and extends vertically. It includes a pair of discharge ducts which extend from its upper portion forwardly to upper forward portions of the firebox opening. Such known device includes a bottom wall which sets down on the floor of the firebox. It includes an inlet duct which extends along one lower side portion of the firebox to a lower corner portion of the air-heater box. It may include a blower which is positioned outside of the firebox. Such device is or has been manufactured by Belmont Industries of 155 John Street, Redding, Mass. 01867, under the trademark "TURB-O-HEAT."

A similar device is manufactured by Therm-Air Industries and marketed by Stone Castle, Inc., of 6160 90th Avenue S. E., Mercer Island, Wash. 98040.

SUMMARY OF THE INVENTION

The fireplace air heater of the present invention is basically characterized by a tubular base of dihedral form and a relatively small-dimension air-heater box, which is supported above such base in a normally relatively hot position within a fire in the fireplace firebox.

According to an important aspect of the invention, the tubular base makes a three-point contact with its supporting surfaces, thus the unit will always seek a stable position even if placed on uneven surfaces.

According to another aspect of the invention, the base includes a side-duct portion which is detachably connected to either end of a rear-duct portion, by use of mounting flanges having lower portions which provide two of the three supports for the unit. The third point of support is provided at or near the front end of the side-duct portion of the base.

Preferably, the air-heater box slopes forwardly so that the flames will contact and sweep over it as they rise in the firebox. The air that is delivered into the hollow base flows out from the base through an opening in an upper intermediate part of the rear-duct portion of the base, through a short transfer duct, and into an inlet provided in an intermediate portion of the air-heater box. The heated air is discharged out through discharge ducts which extend upwardly and forwardly from upper-corner portions of the air-heater box.

The unit is quite efficient even though it includes a relatively small-size air-heater box because the air-heater box is positioned in or near the hottest part of the flame and is leaned forwardly so that it is swept by the flames as they rise.

These and other features, objectives and advantages of the air heater of the present invention will be evident from the preferred embodiment shown by the drawing and described below.

BRIEF DESCRIPTION OF THE DRAWINGS

FIG. 1 is an isometric view taken from above and one side of the fireplace opening, showing the air heater of the present invention located inside of a firebox of a fireplace; FIG. 2 is a vertical sectional view through the fireplace, showing the air heater in side elevation;

DESCRIPTION OF THE PREFERRED EMBODIMENT

Figure 3:
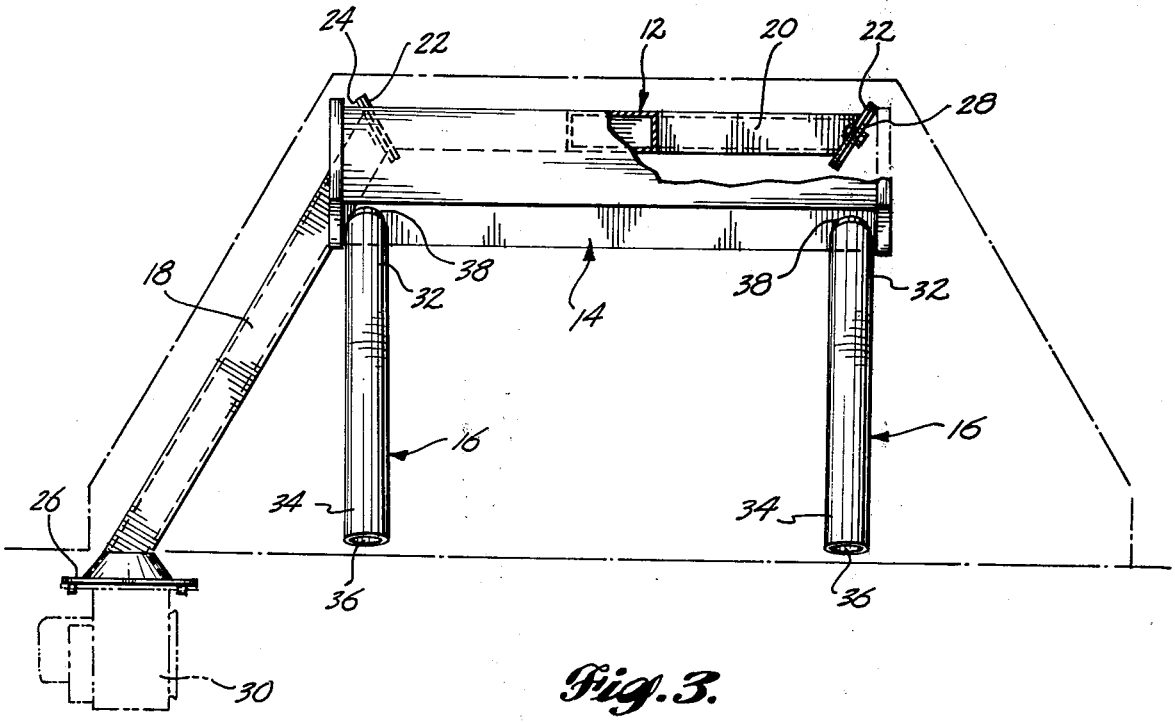
FIG. 3 is a top-plan view of the air heater, shown positioned within the firebox of the fireplace, and including a broken-line showing of the blower, with a portion of the air-heating box being broken away for better illustration of the base structure below it.
Figure 4:
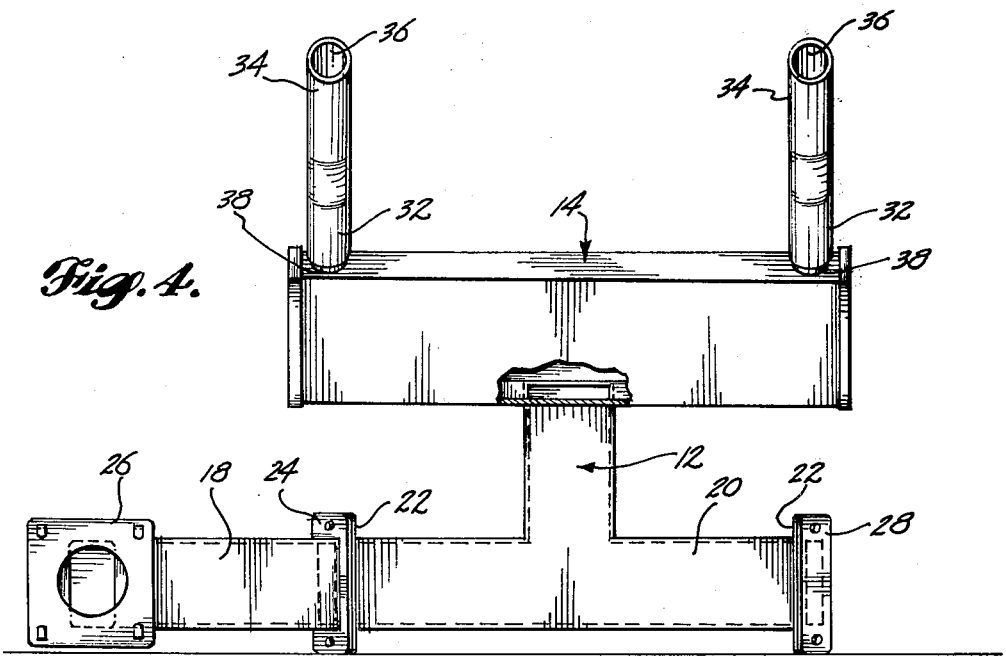
FIG. 4 is a front elevational view of the air heater, with the foreground portion of the air-heating box broken away, in the vicinity of where it is connected to the upper end of the air-transfer tube.

The illustrated or preferred embodiment, which is also the best mode of the invention presently known to me, comprises a tubular base 10 into which the air to be heated is delivered, a vertical transfer duct 12, and elevated air-heating box 14, and a pair of discharge ducts 16.

The tubular base 10 is of dihedral form. It comprises a side-duct portion or section 18 and a rear-duct portion or section 20. The rear section 20 includes a flange 22 at each of its ends. Each flange 22 projects both upwardly above the top and downwardly below the bottom of the rear section 20. The flanges 22 are set at identical acute angles relative to the front wall of rear section 20.

A similar flange 24 is provided at the rear end of side section 18. It also extends at an acute angle relative to the front wall of side section 18. Bolt holes are provided in the upper and lower portions of the flanges 22 and 24, for receiving nut and bolt assemblies which serve to connect the flange 24 to one of the flanges 22.

A fan-mounting flange 26 is provided at the forward end of side section 18. It also extends at an acute angle relative to the front wall of the side section 18.

It is contemplated that the air-heater unit of the present invetion will be dimensioned to fit within a predetermined fireplace firebox. For example, the air heater is especially adapted for use with a type of fireplace which is sometimes referred to as a "zero clearance" fireplace. This is a prefabricated fireplace, which includes a metal firebox that is backed by adequate insulation so that it can be moved into tight contact with wood-framing materials. These fireplaces usually have a relatively small-volume firebox, and space within them is at a premium.

The rear section of the base 20 is sized to extend across the rear wall of a firebox, e.g., the firebox of a zero clearance fireplace. Similarly, the side section 18 is dimensioned to extend along one side of the firebox, and is of a length to place the fan-mounting flange 26 outside of the firebox. The angular relationship of the side section 18 to the rear section 20 at least closely approximates the angular relationship of the side wall of the firebox to the rear wall of the firebox where such walls join the floor of the firebox.

The symmetrical constuction of the rear section 20, including the provision of identical flanges 22 of each of its ends, makes it possible for the side section 18 to be inverted and switched over to the opposite side of the firebox, if desired. A cap plate 28 is bolted to the flange 22, which is not connected to the flange 24, to provide a closure for that end of the back section 20.

The flanges 22, 24, and 26 all project downwardly below the lower surfaces of the base section 18, 20 about the same amount, and serve as support legs for the unit. However, it is contemplated that when the unit is used in a fireplace firebox of a type having a short vertical wall extending across the front of the fireplace, upwardly from the floor of the fireplace, the forward end of side section 18 will be supported by its contact with an upper-edge portion of this wall. The wall height is approximately equal to the clearance below side section 18. The length of the side section 18 is such that the side section 18 will contact and rest on the wall at a location closely rearwardly of the flange 26. However, whether the front end of side section 18 is supported by the lowe edge of flange 26 or by a lower portion of section 18 resting on an upper-edge portion of a fireplace front wall, the base involves a three-point support. The angular relationship of the side section 18 to the rear section 20 places the three points of support at the corners of a triangle and spaces them apart by amounts which result in the base being quite stable despite its asymmetric form.

The location of the side section 18 along one side wall and the location of the rear section 20 generally along the rear wall leaves the central portion of the firebox open or clear so that it may receive whatever appliance might be desirable to facilitate the making of an efficient fire, e.g., andirons, a wood basket, a gas log, etc.

The air-heating box 14 is supported in an elevated position by the transfer duct 12. The air-heating box 14 is elongated in the horizontal direction and is of a length which is substantially equal to the width of the firebox at its location in the firebox. Preferably, the air-heating box is tilted forwardly so that it will be in the flames of a fire in the firebox. The height of air-heating box 14 is such that the air-heating box 14 is closely positioned to the hottest region of the fire.

In operation, forced air is delivered by the fan 30 into the forward end of duct 18. It flows through duct 18 and then into duct 20. The incoming air is delayed in the base 18, 20 somewhat by virtue of the fact that the only outlet from the tubular base 18, 20 is by way of the short transfer duct 12, which extends upwardly from an outlet which is intermediate the two ends of section 20. After flowing through duct 12, the air spreads out in both directions within the air-heating box 14 and whirls around within the air-heating box 14 due to the manner in which it is delivered into the air-heating box 14. Eventually, the heated air will flow out from air-heating box 14 by way of one or the other of the discharge tubes 16.

The discharge tubes 16 include a first or rear section 30 which extends upwardly at about the same angle as the angle or tilt of the air-heating box 14, and a lesser-sloping forward section 34. The discharge tubes 16 are dimensioned to place their outlets 36 closely adjacent the front of the firebox. Preferably, the fireplace is equipped with a spark screen and the outlets are positioned behind upper-corner protions of such screen.

As will be appreciated, the air-heating unit of this invention is composed of a small number of small parts which are arranged to take up very little room in the firebox, and to closely hug boundary portions of the firebox, with the principal air-heating portion thereof being located in or closely near the hottest part of the fire. The unit is attractive and quite efficient, yet due to its simplicity is relatively inexpensive to manufacture.

By way of typical and therefore nonlimitative example, the ducting for the base sections 18, 20 and the transfer duct 12 may measure about one and one-half inches by three inches. The flanges 22, 24, and the closure cap 28, may measure about two inches by five inches and be arranged to place the bottom surfaces of the ducts 18, 20 about one inch above the floor. The air-heater box may be constructed from metal tubing measuring about two inches by five inches. Side-duct portion 18 of the base may measure about nineteen inches on its long side, and rear-duct portion 20 may also measure about nineteen inches on its long side. Air-heater box 14 may be about twenty inches long. The lower forward-edge portion of the air-heater box may be spaced about nine inches above the floor of the firebox, and its upper-rear edge may be spaced about fourteen inches above the floor of the firebox. The stub tubes 38 leading out from the air box to telescopically engage the ducts 16, may measure one and seven-eighths inches in outside diameter. The discharge ducts 16 may measure about ten inches from their inner ends up to the center of the angle and about six and one-half inches from the center of the angle out to their discharge ends, and be dimensioned at their inner ends to frictionally engage the stub tubes 38. The blower may be a conventional squirrel-cage blower having a tangential outlet.

What is claimed is:

1. an air heater insertable into a firebox, comprising: a tubular base, including an elongated side duct portion sized to extend from the front to the rear of a predetermined fireplace firebox, along a lower side portion thereof, and an elongated rear duct portion sized to extend across the lower rear portion of such firebox, said side duct portion having an air inlet at its forward end for receiving air to be heated, and at its rearward end being coupled to the rear duct portion, said rear duct portion including an upwardly directed outlet intermediate its end;

a horizontally elongated air-heater box spaced above the rear duct, said air-heater box including a downwardly directed air inlet intermediate its ends, and at least one forwardly directed heated air outlet at one end thereof;

a vertical transfer duct interconnected between the outlet of the rear duct portion of the tubular base and the inlet of said air-heater box, said vertical transfer duct being of a length to position the air-heated box in a normally relatively hot position within a fire in the fireplace firebox;

an outlet duct extending upwardly and forwardly from the outlet of said air-heater box and discharging forwardly from an upper, front corner position in the fireplace firebox;

wherein the rear duct portion of the tubular base includes a vertically elongated flange at each of its ends, each having a lower portion which depends below the tubular base to serve as a support leg for the tubular base, and with the forward part of the side duct portion of said tubular base serving as a third point of support for the tubular base, so that the tubular base is supported at three points representing corners of a triangle; and wherein the side duct portion of the tubular base includes a vertically elongated flange at its rear end matching the flange at the adjoining end of the rear duct portion of the tubular base, and wherein connector elements extend between the two flanges for coupling the side and rear duct portions of the tubular base together.

2. An air heater according to claim 1, wherein the flanges at each end of the rear duct portion of the tubular base are substantially identical, and wherein the side duct portion of the tubular base is invertible so that it can be inverted and repositioned over on the opposite side of the fireplace firebox, and be attached to the opposite end of the rear duct portion of the tubular base, and said air heater including a closure member that is boltable to the flange at the end of the rear duct portion of the tubular base which is opposite the end to which the side duct portion of the tubular base is attached.

3. An air heater according to claim 1, wherein the air heater box is of rectangular proportions and is connected to the transfer duct at an angle such that it leans forwardly at an acute angle with respect to the floor of the firebox.

4. An air heater according to claim 3, wherein the side and rear duct portions of the tubular base and the vertical transfer duct are formed from lengths of a first size of rectangular tubing and the air-heater box is constructed from a length of a larger size of rectangular tubing.

5. An air heater according to claim 4, wherein the outlet duct comprises a cylindrical stub section of a first diameter welded to a forward-edge portion of the air-heater box, about an outlet opening therein, and a cylindrical duct member having an inner-edge portion adopted to telescopically engage said stub tube.

* * * * *